US008715140B1

(12) United States Patent
Gertz

(10) Patent No.: US 8,715,140 B1
(45) Date of Patent: May 6, 2014

(54) STABILIZED VERTICAL ROPE CLIMB APPARATUS FOR CHILDREN

(75) Inventor: Dale Gertz, Greensboro, NC (US)

(73) Assignee: Climb Anytime, LLC, Greensboro, NC (US)

( * ) Notice: Subject to any disclaimer, the term of this patent is extended or adjusted under 35 U.S.C. 154(b) by 604 days.

(21) Appl. No.: 13/026,537

(22) Filed: Feb. 14, 2011

(51) Int. Cl.
*A63B 21/00* (2006.01)

(52) U.S. Cl.
USPC ..... 482/35; 482/83; 482/87; 482/90

(58) Field of Classification Search
USPC ..... 482/83, 87, 90, 35, 148
See application file for complete search history.

(56) References Cited

U.S. PATENT DOCUMENTS

| | | | | |
|---|---|---|---|---|
| 214,570 | A | 4/1879 | Keiser | |
| D214,570 | S | 4/1879 | Keiser | D34/5 |
| 641,519 | A | 1/1900 | Kerns | |
| 3,337,217 | A * | 8/1967 | Cummins | 473/442 |
| 3,445,108 | A | 5/1969 | Fenner et al. | |
| 3,642,277 | A | 2/1972 | Gersten | |
| 3,782,718 | A | 1/1974 | Saylor | |
| 3,794,316 | A | 2/1974 | Toman | |
| 4,116,433 | A | 9/1978 | Koerner | |
| 4,270,750 | A | 6/1981 | Malcolm | |
| 4,278,250 | A | 7/1981 | Baynes et al. | |
| 5,076,574 | A | 12/1991 | Johnson, Jr. | |
| 5,330,400 | A | 7/1994 | Huberman | |
| 5,341,758 | A | 8/1994 | Strickland | |
| 5,484,360 | A | 1/1996 | Haber et al. | |
| 5,836,801 | A | 11/1998 | Lin | |
| 6,743,157 | B2 * | 6/2004 | Hackaday | 482/83 |
| 7,018,323 | B1 | 3/2006 | Reynolds et al. | |
| 7,086,991 | B2 | 8/2006 | Williams et al. | |
| 7,811,204 | B2 | 10/2010 | Popescu | |

* cited by examiner

*Primary Examiner* — Jerome W Donnelly
(74) *Attorney, Agent, or Firm* — MacCord Mason PLLC

(57) ABSTRACT

An apparatus for climbing includes an elongate body having an outer surface with a rope-like texture, a length of at least six feet and a diameter not greater than four inches, a stiffness such that it cannot be looped around part of a child, and a mount on one end of the body for connecting the body to an elevated support. The elongate body can be mounted to an elevated support and thereby be suspended from the elevated support to allow a child to climb the apparatus without risking strangulation from looping of the elongate body around part of the child.

10 Claims, 9 Drawing Sheets

STABILIZED VERTICAL ROPE CLIMB APPARATUS FOR CHILDREN

BACKGROUND OF THE INVENTION

This invention relates generally to a children's vertical gymnastic climb toy with portability feature, more particularly to a children's upright, stabilized rope climb fitness and recreation apparatus capable of being mounted for use indoors or outdoors.

For years, the multi-billion dollar health and fitness industry has disproportionately focused on health promotion in adult individuals as a prescription for happy and healthy long life. Well-publicized reports of the pressing need to improve the nation's population health have increasingly inspired individual and population-based wellness activity. In response, families and schools are increasingly committed to ensure that children are sufficiently exposed to health-promoting physical activity.

Experts recommend that children capable of physical activity should engage in exercise that is aerobic, muscle and bone strengthening. To the naturally playful child, climbing vertically up and down a length of rope or rope-type apparatus is a virtually irresistible activity. Whether enjoyed alone or in the company of ones' peers, this physical activity is at once challenging, body strengthening, and exhilarating to a young child. Though less prevalent today, rope climbing exercise continues to attract young people wherever offered, most typically at some schools, fitness gymnasiums, and military venues. Although opportunities for children to enjoy vertical climbing have been largely limited to these venues, from time to time the opportunity also presents on outdoor playground structures featuring some type of ladder or other vertically-oriented climb equipment. Whatever the venue, it is to be acknowledged that children by and large enjoy climbing wherever and whenever given the opportunity.

As a health promoting physical activity, rope climbing stimulates the cardiovascular system while strengthening wrists, hands, and upper body muscles. It is considered to be an effective fitness exercise and tool for training the upper body because the user is required to support his or her entire weight while ascending the rope. Descending the rope also provides upper body training to the user.

Prior art reveals flexible, unreinforced climbing ropes of considerable length (20 foot), typically mounted in fitness gyms. Although the climbing ropes are sufficiently durable to support their intended work load, the inherently loose and elastic property of the rope coupled with the height of the vertical climb combine to create substantial disadvantage and risks of serious slip and fall injuries to climbers. Suspended from a ceiling fixture or support rafter high above the gym floor, these flaccid and unrestrained climbing ropes are prone to sway, twist and turn unpredictably during use. As such, these apparatus pose risks of harm to children.

Conventional rope that has not been stabilized has a propensity to twist and sway uncontrollably when used in climbing.

Since most type of ropes used in the gymnasium rope climb setting are usually made of rough material such as hemp, climbers ascending and descending such gymnasium-mounted ropes are more susceptible to sustain abrasions or injury to legs, feet, arms and/or hands. Thus, preferred embodiments of the present invention use a rope of less abrasive rope material, polypropylene. However, other rope materials can be used.

SUMMARY OF THE INVENTION

The present invention fulfills one or more of these needs in the art by providing an apparatus for climbing including an elongate body having an outer surface with a rope-like texture, a length of at least six feet and a diameter not greater than four inches, the body having a stiffness such that it cannot be looped around part of a child. A mount on one end of the body is included for connecting the body to an elevated support. Thus, the elongate body can be mounted to an elevated support and thereby be suspended from the elevated support to allow a child to climb the elongated body without risking strangulation from looping of the elongate body around part of the child. Preferably, the stiffening rod extends continuously along a substantially the entire length of the elongate body.

In one embodiment the elongate body is made with a rope braided around a stiffening rod. The stiffening rod may be sheathed by at least one length of rope. The stiffening rod may have a hole in each end, with the sheathed rope anchored to the stiffening rod by connectors through the holes in the stiffening rod.

The elongate body may be made of first and second segments of rope, each of the first and second segments of rope being at least twice as long as the elongate body. In this embodiment, the first segment of rope has a stiffening rod sheathed by the first segment of rope, the stiffening rod being slightly shorter than the elongate body, such that the first segment of rope is stiff along about one half of its length. The other half of the first segment and two halves of the second segment are braided around the stiff length of the first segment. Preferably, the braided halves of the first and second segments form thickened portions spaced along the length of the elongate body.

In a preferred embodiment the stiffening rod is stainless steel. Also preferably, the rope is polypropylene. The mount may include a carabiner with twist-locking sleeve.

In another embodiment the elongate body is formed of a stiffening rod core with a molded polymer or elastomer forming the outer surface with rope-like texture.

The invention can also be considered as a method of making a climbing apparatus including inserting a stiffening rod into a rope to sheath the rod with the rope, braiding additional rope around the rope having the inserted stiffening rod to form a stiff, elongate body with a rope texture, and affixing a mount to one end of the elongate body so that it can be suspended from an elevated support.

Inserting the rod may include inserting the rod into a one half of the length of a first rope segment, and braiding additional rope may include using another half of the length of the first rope segment in braiding.

The method may also include anchoring the stiffening rod to the rope that sheaths the rod to inhibit lengthwise movement of the rod within the rope sheath.

The method may also include the preliminary step of removing a core from the rope to make room for the stiffening rod to be inserted into the rope.

Braiding additional rope may include leaving a loop of rope at one end of the elongate body, thereby affixing at least a portion of the mount. Affixing the mount may further include attaching a carabiner to the loop.

Another embodiment of the method of making a climbing apparatus includes locating a stiffening rod in an interior of a mold and introducing a flowable polymer or elastomer to the mold so that it surrounds the rod in the mold and so that the flowable polymer or elastomer forms an outer surface with a rope-like texture from the inner surface of the mold. The flowable polymer or elastomer is allowed to cure, thereby forming an elongate body having an outer surface with a rope-like texture, a length of at least six feet and a diameter not greater than four inches, the body having a stiffness such that it cannot be looped around part of a child.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
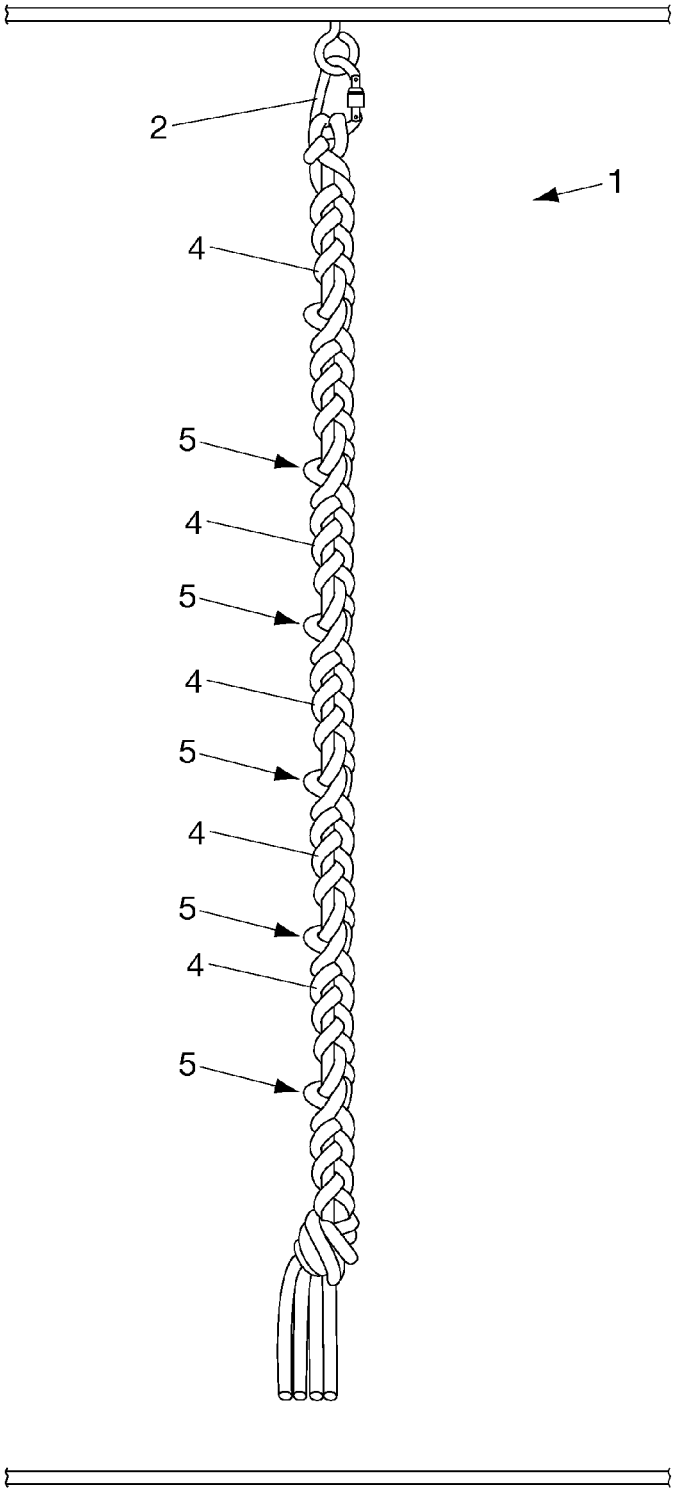
FIG. 1 is an elevational view of an installed embodiment of the present invention.

The preferred embodiment of the present invention provides a vertical rope climbing toy for children in the form of an elongate body featuring braided polypropylene grip holds and knotted climbing supports spaced sequentially along a rope-sheathed reinforcing rod. The body should be at least 6 feet long and have a diameter not greater than four inches. Various lengths longer than six feet are within the scope of the invention. As illustrated in FIG. 1, this children's vertical rope climb toy 1 is configured for recreational play and exercise. A twist-locking screwgate 2 is included. This screwgate can take the form of a carabiner with a twist-locking sleeve that prevents inadvertent opening of the carabiner. The screwgate allows the toy to be suspended from an elevated support (for example, an eyelet protruding downward from an outdoor swing set or the ceiling of a child's bedroom), rendering the toy portable and adaptable for use indoors or outdoors. Built around a rope-sheathed stiffening rod 3, the toy preferably includes braided polypropylene grip holds 4 and knotted climbing supports 5. Typically, the diameter of most of the length of the elongate body (i.e. where the grip holds 4 are located) is about 1½ inches or less, except the knots 5 are on the order of three inches in diameter in a preferred embodiment.

Figure 2A:
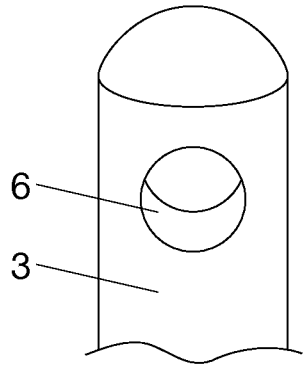
FIG. 2*a* is an enlarged view of one of the ends of the stiffening rod of the embodiment of FIG. 1, preferably made of stainless steel showing the ⅛ inch diameter hole located near the rod end.
Figure 2B:
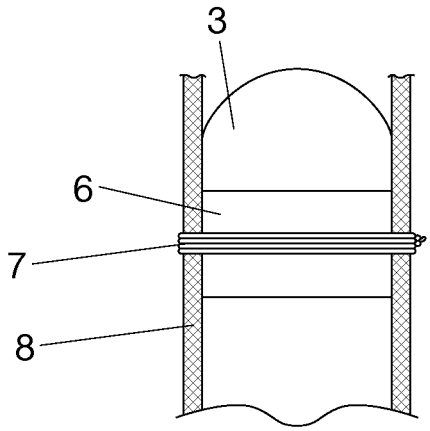
FIG. 2*b* is an enlarged sectional view of one of the ends of the sheathed stiffening rod of the embodiment of FIG. 1 showing a securing monofilament line passed through the hole, polypropylene sheathing and stiffening rod.

Forming the core of the preferred embodiment of the climbing toy is a ¼ inch diameter 316 gauge nonflexible stiffening stabilization rod 3 measuring six feet in length. Preferably, the ends of the rod are smoothened to remove pitting, sharp edges or burrs. Referring to FIGS. 2*a* and 2*b*, a ⅛ inch diameter hole is drilled through the rod near each end, such as ½ inch from each end. Monofilament line 7 is used to secure the polypropylene rope sheath 8 to the rod using the holes 6 located at each end of the stabilization rod 3. Other ways to anchor the sheath to the rod will be apparent to those of ordinary skill in the art and can also be used within the scope of the invention.

Figure 4:
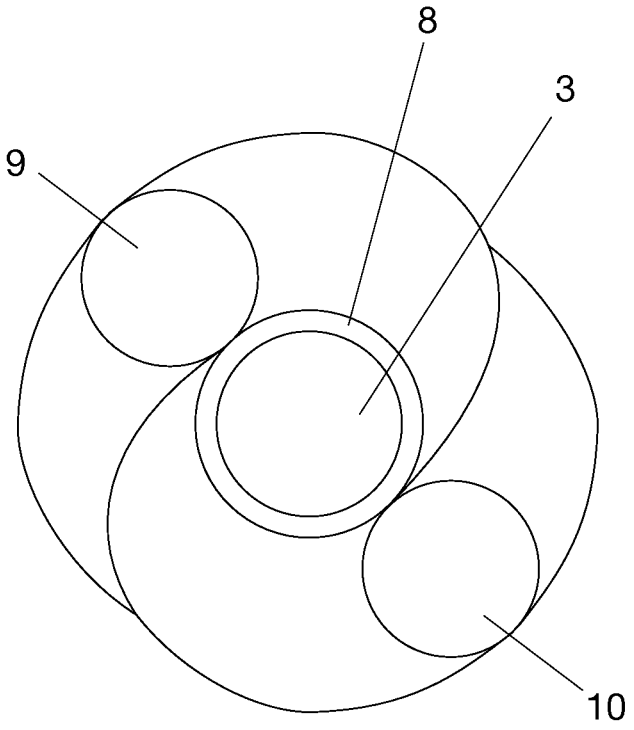
FIG. 4 is a cross sectional view of the embodiment of FIG. 1 showing the internal structure thereof.
Figure 5:
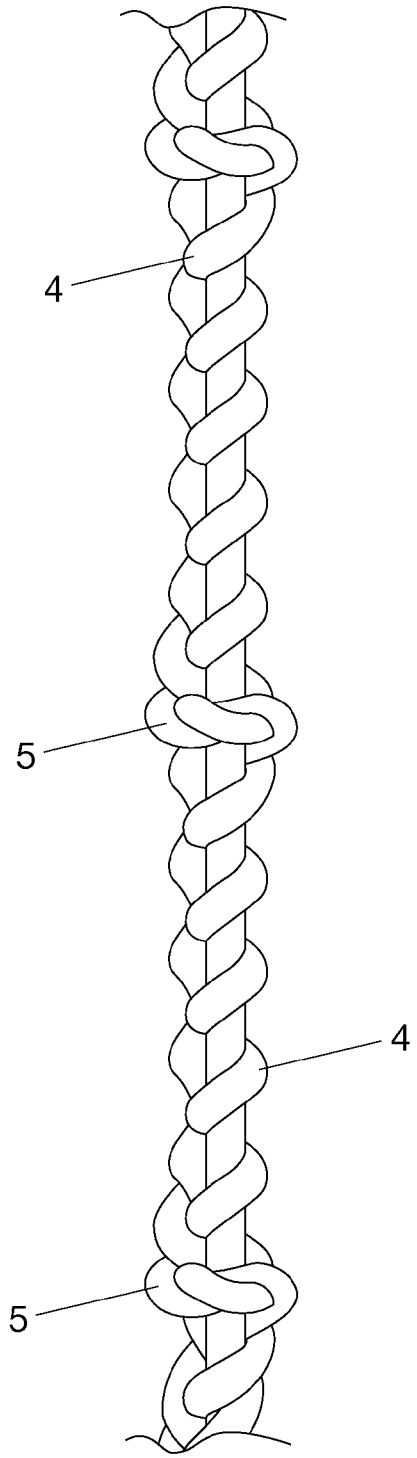
FIG. 5 is a fragmentary enlarged reverse view of the embodiment of FIG. 1, to more clearly show the structure thereof.

Referring to FIG. 2*b*, FIG. 4 and FIG. 5, two lengths of ⅝ inch diameter pre-braided polypropylene rope are combined into the climbing toy assembly. The first rope 9 (Rope A) is preferably twenty-two feet long, and the second rope 10 (Rope B) is preferably twenty-five feet long. Other lengths may be substituted, with the objective of using up the length of the ropes in the making of the elongate body with minimal amounts of the rope left over. About one half of Rope A 9 is hollowed out and then receives the rod 3, tautly and completely sheathing the six foot stiffening rod in braided polypropylene rope. Polypropylene rope is made with a core of strands distinct from the peripheral strands. This core can be removed to hollow out the rope. Tautly covering the non-flexible stiffening rod in a sheath of flexible, easy-to-grip polypropylene-braided rope material facilitates recreational safety and stability of this children's vertical rope climbing toy.

Figure 3A:
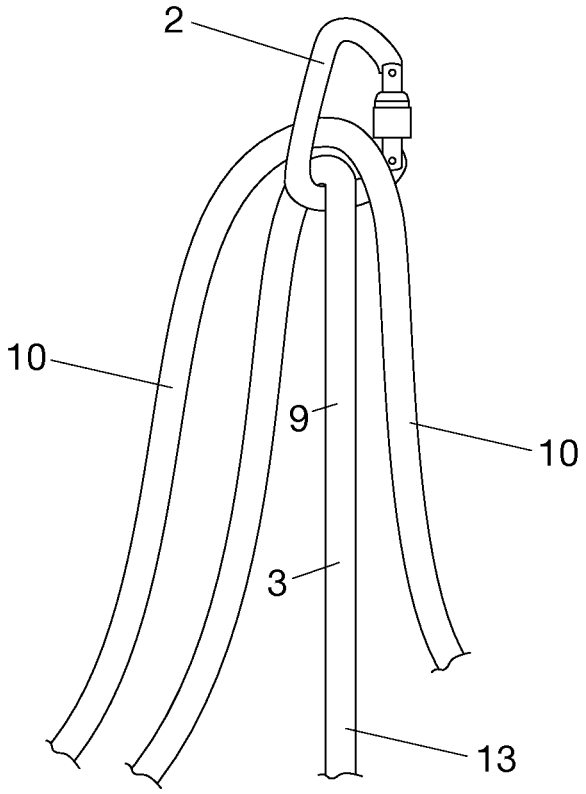
FIG. 3*a* shows Ropes A and B of the embodiment of FIG. 1 introduced through the screwgate.

As shown in FIG. 3*a*, the sheathing rope from Rope A extends an additional two feet 13 beyond the bottom end of the rod 3. The balance of Rope A 9, approximately fourteen feet of polypropylene rope, overhangs the top of the screwgate 2.

Following the rod sheathing process, as shown in FIG. 2*b* the polypropylene sheath of rope A is further secured to the rod 3 using monofilament nylon line 7. Using the holes 6 located at the end of the rod, approximately eight inches of monofilament 7 is needed at each end of the rod 3 to bind the sheathing rope to the rod 3. The monofilament 7 is inserted through an outer ply of the rope material 8, through the hole 6, then out the other side of hole 6 and through the opposite ply of sheathing rope. It is then passed around the outside of the rope. This action is repeated approximately 10 times, each time re-tightening the joined material. The monofilament is knotted and tied, trimming away excess line. The anchoring action is repeated on the opposite end of the sheathed rod. Monofilament 7 functions to anchor the ends of the sheathed rod, impeding internal movement or shifting of the rod inside the sheathing rope. Other ways to anchor this sheath to the rod can be substituted, and in some cases anchoring can be omitted.

Figure 3B:
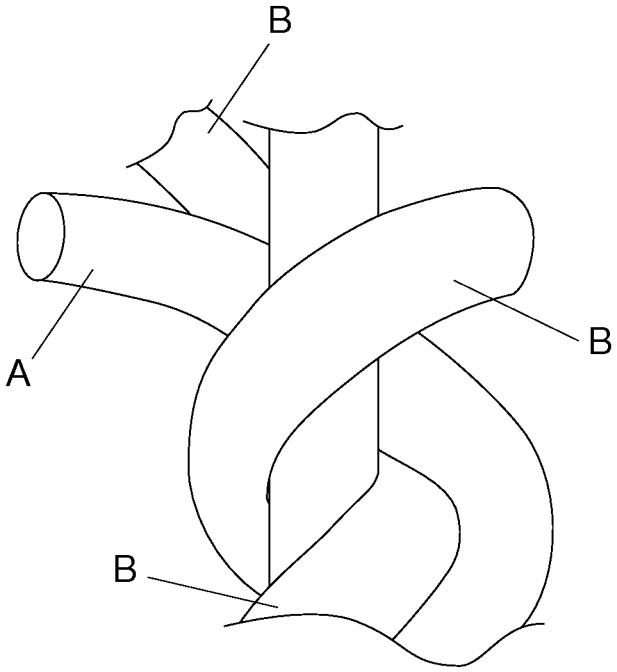
FIG. 3*b* is a fragmentary enlarged view showing rope-braided grip holds of the embodiment of FIG. 1.

As shown in FIG. 3*a*, the fourteen foot length of rope from Rope A 9 overhanging the top of the rod is looped through the locking screwgate 2. Rope B 10 is similarly looped through the screwgate 2 so that two generally equal lengths hang down from the screwgate. To strengthen and secure the apparatus from this point of origin, a half-knot is used to combine the overhanging rope from Rope A with one of the overhanging lengths of rope from Rope B. Working downward from the screwgate at the top, a patterned three-rope braiding process continues using the rope from Rope A in combination with the two lengths of rope from Rope B. As shown in FIG. 3*b*, the three lengths of rope are braided together, downward along and around the sheathed rod using the following conventional rope-braiding method: The length of rope located at the far right is positioned in front of the middle rope and in front of the rope-sheathed rod, then placed between the rope located far left and the middle rope. The rope located far left is then placed behind the rope that is in the middle position and behind the rope-sheathed rod, then moved between the ropes that have just been shifted to the middle and right positions.

The braiding action takes place as the overhanging length of rope from Rope A and the two lengths of rope from Rope B are combined to encircle the rope-sheathed rod. These ropes are braided alternately in front of, then behind the rope-sheathed rod. Throughout the braiding process, each individually completed braid is pulled taut to minimize subsequent loosening or slippage of the braids. A sectional view of the apparatus transverse to the rod 3 may look like the view of FIG. 4.

As shown in FIG. 5, through sequential braiding and knotting, the ropes are combined along the length of the rod 3 to form polypropylene rope-braided grip holds 4 and knotted climbing supports 5, which aid the toy's operation and function. The grip holds are the outer surface of the elongate body formed by the braiding of ropes A and B together. The braiding is repeated until five braided grip holds are consecutively obtained and tautly secured along the rod. Following completion of the fifth braided grip hold 4, the first of six knots 5 that form the climbing supports 5 is secured into position on the climbing rod using the polypropylene rope from Rope A and Rope B. The three-rope braiding and knotting sequence continues downward along the vertical climbing rod, each time creating five tautly braided grip holds followed by a knot-securing climbing support. Evenly spaced along the length of the vertical climbing rod, the six knotted climbing supports strengthen the climbing apparatus, increase overall safety, and provide an enhanced exercise climb experience for children. Other numbers of knots and other knot spacings (i.e. numbers of braids between knots) can also be used within the scope of the invention.

Figure 7:
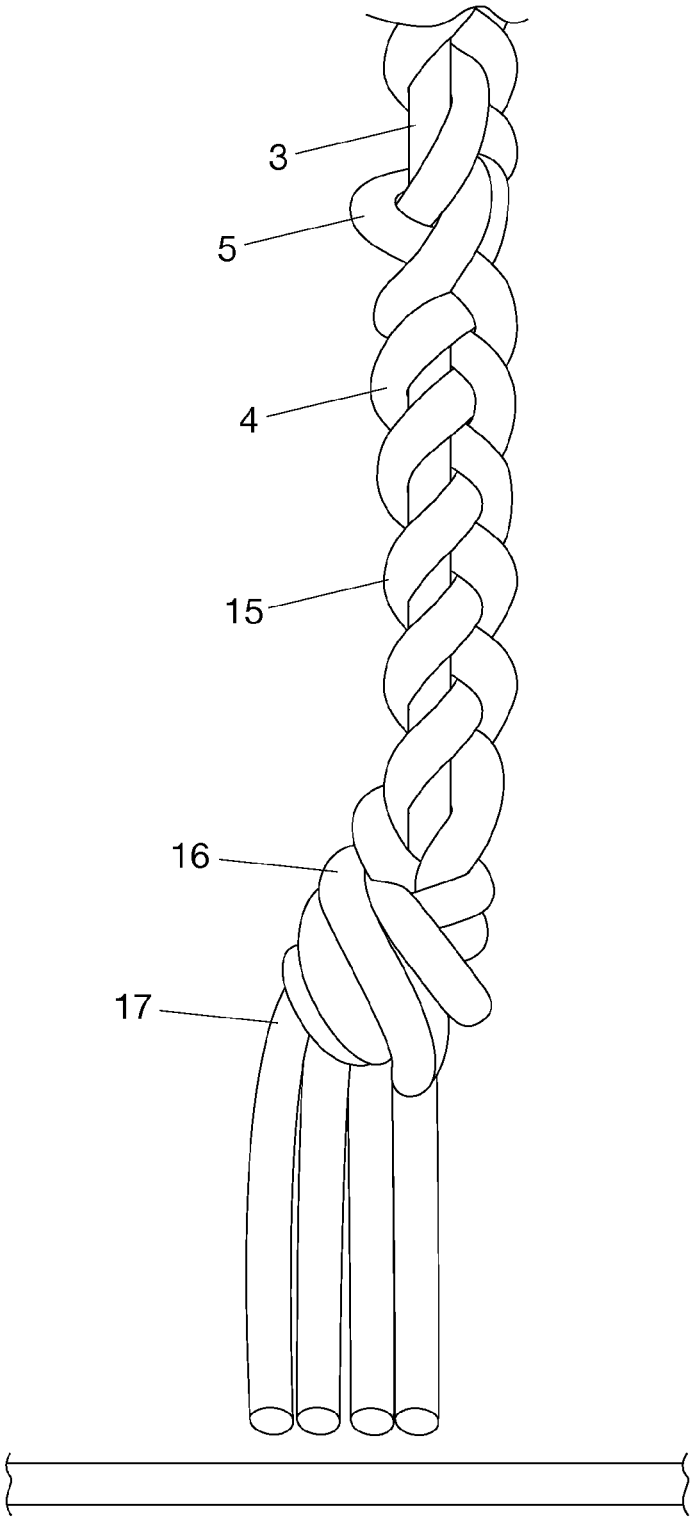
FIG. 7 is a fragmentary enlarged view of FIG. 1 more clearly showing the lowermost section of the embodiment of FIG. 1.

As shown in FIG. 7, beneath the sixth and final knotted climbing support there is sufficient space available on the lowermost section of the sheathed rod to accommodate five braided foot holds 15. The remaining rope ends, suspended beneath the sheathed rod, are then looped and secured together using a "FIG. 8" style securing knot 16. This knot tightens under load, making it an ideal method for securing and finishing the rope climb assembly at bottom. Rope ends dangling beneath the knot 16 are then trued up. Uneven rope ends are trimmed to ensure that the ends terminate evenly at the bottom of the toy. The tips of the rope ends are then heat-seared 17, thereby strengthening the toy and preventing end-rope degradation.

Figure 6:
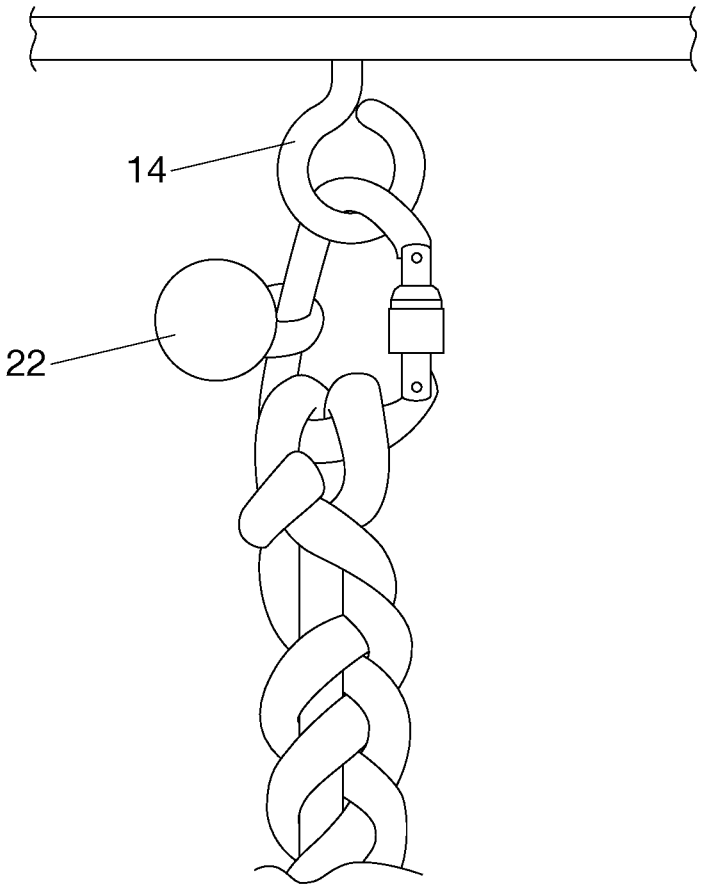
FIG. 6 is a fragmentary enlarged view of FIG. 1, showing the uppermost section of the embodiment of FIG. 1 containing screwgate assembly.

FIG. 6 shows in sectional view the upper assembly of the present invention completed and connected to a ceiling-mounted lag eye screw 14. An accessible, touch-activated sound emitting device, clicker, ringer, bell, other novelty noisemaker 22 may be conveniently fixed to the accommodating twist-locking screwgate assembly using a detachable fastening strap such as by hook-and-loop fasteners (not shown). The sound emitted device invites the climbing child to activate it to signal satisfaction and self-accomplishment when the top section of the climbing toy is within reach.

Operation

The manner of using this support-structure mounted vertical rope climb invention is quite simple. Using both hands and feet, the child climber boards the rope climbing apparatus along the sheathed rod 3 starting at knot 16. Using the polypropylene grip holds 4 and knotted climbing supports 5 spaced along the rod, the climber begins ascending the apparatus. Alternating use of hands and feet lifts and pulls the exercising climber upward. Upon reaching the top, the child climber may signal satisfaction and accomplishment by depressing the touch-activated sound emitting device, clicker, ringer, bell, other novelty noisemaker. In similar fashion, the climber may descend from the vertical climbing device.

The embodiments of the present invention introduce appreciable safety enhancements conveniently built into the apparatus and which are not present in rope climbing prior art. Knotted climbing supports and braided grip holds provide safety features to the operation, function, and recreational enjoyment of the vertical rope climbing invention. Spaced sequentially along the length of a sheathed rod, these supports and holds provide improvement over prior art vertical climbing apparatuses, substantially enhancing safety and ease of use for children engaging in vertical climb exercise.

Additionally, introduction of the rod into the climbing rope effectively eliminates any danger of strangulation present when climbing unreinforced climbing apparatuses. The rod's reinforcing structure minimizes the possibility that the climbing rope will twist or turn unpredictably or become looped about the neck or other part of a climbing child. A twist-locking screwgate at the top of the assembly renders the unit conveniently adaptable for indoor or outdoor recreational use at home.

Preferred embodiments of the present invention may be operated from virtually any space-accommodating area within the home having a minimum vertical ceiling-to-floor height of 8 feet. Other sizes and heights are within the scope of the invention. Typical areas within the home include, without limitation, children's rooms, recreation rooms, playrooms, bedrooms, basements, and a plurality of other interior locations having structurally sound ceiling and floor space.

Figure 8:
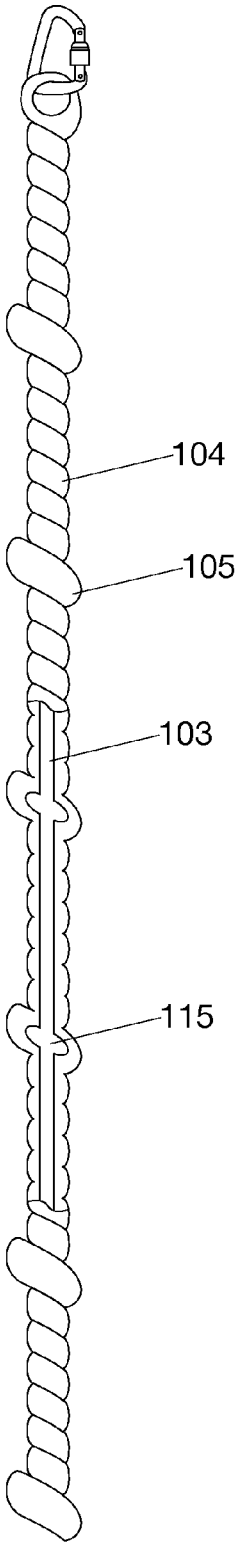
FIG. 8 is an elevational view of an alternative embodiment, partially broken away.

In another embodiment seen in fragmentary view in FIG. 8, the elongate body is formed of a stiffening rod core with a molded polymer or elastomer forming the outer surface with rope-like texture. That texture preferably includes parts 104 and 105 that simulate the braided grip holds 4 and knotted climbing supports 5. A rod 103 like the ones discussed above can be located in the interior of a mold. The flowable polymer or elastomer is introduced to the mold so that it surrounds the rod in the mold and then is allowed to cure. The mold imparts the rope-like texture to the outer surface of the cured polymer or elastomer. It is expected that the holes in the ends of the stiffening rod referred to above will not be needed in this embodiment, since the molding material will adhere to the rod and prevent sliding of the rod within the sheath formed by the molding material. If desired, the central rod can have thickened portions to align with wider portions 115 of the mold, corresponding to the knot locations of the first embodiment. Such a structure will further prevent sliding of the rod within the sheath formed by the molding material as well as providing the desired outer surface 105 to simulate the knots. This embodiment can also be made in various lengths.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for climbing comprising an elongate body having an outer surface with a rope-like texture, a length of at least six feet and a diameter not greater than four inches, the body having a stiffness such that it cannot be looped around part of a child, and a mount on one end of the body for connecting the body to an elevated support, whereby the elongate body can be mounted to an elevated support and thereby be suspended from the elevated support to allow a child to climb the apparatus without risking strangulation from looping of the elongate body around part of the child, wherein the elongate body is made of a rope braided around a stiffening rod.

2. An apparatus as claimed in claim 1 wherein the stiffening rod is sheathed by at least one length of rope.

3. An apparatus as claimed in claim 2 wherein the stiffening rod has a hole in each end and the sheathed rope is anchored to the stiffening rod by connectors through the holes in the stiffening rod.

4. An apparatus for climbing comprising an elongate body having an outer surface with a rope-like texture, a length of at least six feet and a diameter not greater than four inches, the body having a stiffness such that it cannot be looped around part of a child, and a mount on one end of the body for connecting the body to an elevated support, whereby the elongate body can be mounted to an elevated support and thereby be suspended from the elevated support to allow a child to climb the apparatus without risking strangulation from looping of the elongate body around part of the child wherein the elongate body is made of first and second segments of rope, each of the first and second segments of rope being at least twice as long as the elongate body, the first segment of rope having a stiffening rod sheathed by the first segment of rope, the stiffening rod being slightly shorter than the elongate body, such that the first segment of rope is stiff along about one half of its length, the other half of the first segment and two halves of the second segment being braided around the stiff length of the first segment.

5. An apparatus as claimed in claim 4 wherein the braided halves of the segments form thickened portions of the elongate body spaced along the length of the elongate body.

6. An apparatus as claimed in claim 1 wherein the stiffening rod is stainless steel.

7. An apparatus as claimed in claim 1 wherein the rope is polypropylene.

8. An apparatus as claimed in claim 1 wherein the mount includes a carabiner.

9. An apparatus for climbing comprising an elongate body made of polypropylene rope braided around a stiffening rod and having an outer surface with a rope-like texture, the elongate body having a length of at least six feet and a diameter not greater than four inches, the elongate body having a stiffness such that it cannot be looped around the part of a child, wherein the elongate body is made of first and second segments of rope, each of the first and second segments of rope being at least twice as long as the stiffening rod, wherein the stiffening rod is sheathed by one half of the first segment of rope and the stiffening rod has a hole in each end and the one half of the first segment of rope having the stiffening rod sheathed in it is anchored to the stiffening rod by connectors through the holes in the stiffening rod, the stiffening rod being slightly shorter than the elongate body, such that the first segment of rope is stiff along about one half of its length, the other half of the first segment and two halves of the second segment being braided around the stiff length of the first segment, wherein the braided halves of the first and second segments form thickened portions of the elongate body spaced along the length of the elongate body, and a mount on one end of the body for connecting the body to an elevated support, whereby the elongate body can be mounted to an elevated support and thereby be suspended from the elevated support to allow a child to climb the apparatus without risking strangulation from looping of the elongate body around part of the child.

10. An apparatus for climbing comprising an elongate body having an outer surface with a rope-like texture, a length of at least six feet and a diameter not greater than four inches, the body having a stiffness such that it cannot be looped around part of a child, and a mount on one end of the body for connecting the body to an elevated support, whereby the elongate body can be mounted to an elevated support and thereby be suspended from the elevated support to allow a child to climb the apparatus without risking strangulation from looping of the elongate body around part of the child wherein the elongate body is formed of a stiffening rod core with a molded polymer or elastomer forming the outer surface with rope-like texture.

* * * * *